United States Patent [19]

Borgen

[11] 4,154,288

[45] May 15, 1979

[54] INJECTION MOLDING MACHINE HAVING SWIVEL SHOT TIP ASSEMBLY

[75] Inventor: Arden L. Borgen, Webster City, Iowa

[73] Assignee: Arrow-Acme Corporation, Webster City, Iowa

[21] Appl. No.: 847,945

[22] Filed: Nov. 2, 1977

[51] Int. Cl.[2] ..... B22D 17/08

[52] U.S. Cl. ..... 164/314; 164/312; 92/187

[58] Field of Search ..... 164/113, 303, 312, 314–316, 164/318; 222/596; 92/187

[56] References Cited

U.S. PATENT DOCUMENTS

| | | | |
|---|---|---|---|
| 2,198,623 | 4/1940 | Kastler | 92/187 |
| 3,960,201 | 6/1976 | Portalier | 164/312 |

FOREIGN PATENT DOCUMENTS

| | | | |
|---|---|---|---|
| 11426 | 3/1971 | Japan | 164/113 |

*Primary Examiner*—Othell M. Simpson

*Assistant Examiner*—J. Reed Batten, Jr.

*Attorney, Agent, or Firm*—James E. Nilles

[57] ABSTRACT

A shot tip assembly for an injection molding machine of the type having a shot tube for conducting molten material into a die cavity of the machine. The shot tip assembly has a shot tip which is reciprocal within the tube and forms a close sliding fit with the tube for forcing the molten material through the tube and into the die cavity. A shot tip adapter is provided for the shot tip and has one end captively but relatively movably mounted in the shot tip, the adapter being connected at the other end to a reciprocal shot rod. A movable or swivel connection is provided between the adapter and the tip to permit the tip to move or swivel slightly on the adapter to thereby accommodate any misalignment between the shot tube and the shot tip as they are moved relative to one another. The injection machine with which the shot tip assembly is used has power means for example, a hydraulic shot cylinder for driving the shot rod, and consequently, the shot tip in the shot tube.

23 Claims, 7 Drawing Figures

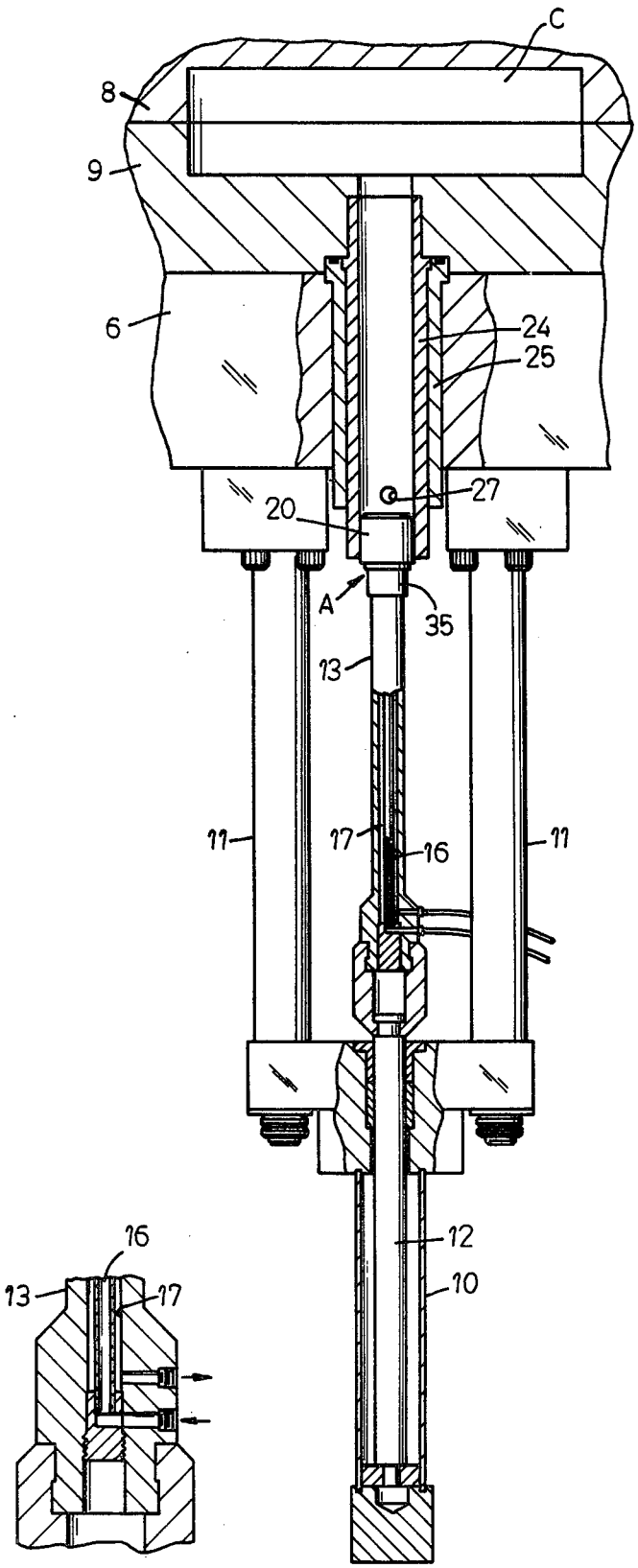
FIG. 2
FIG. 2a
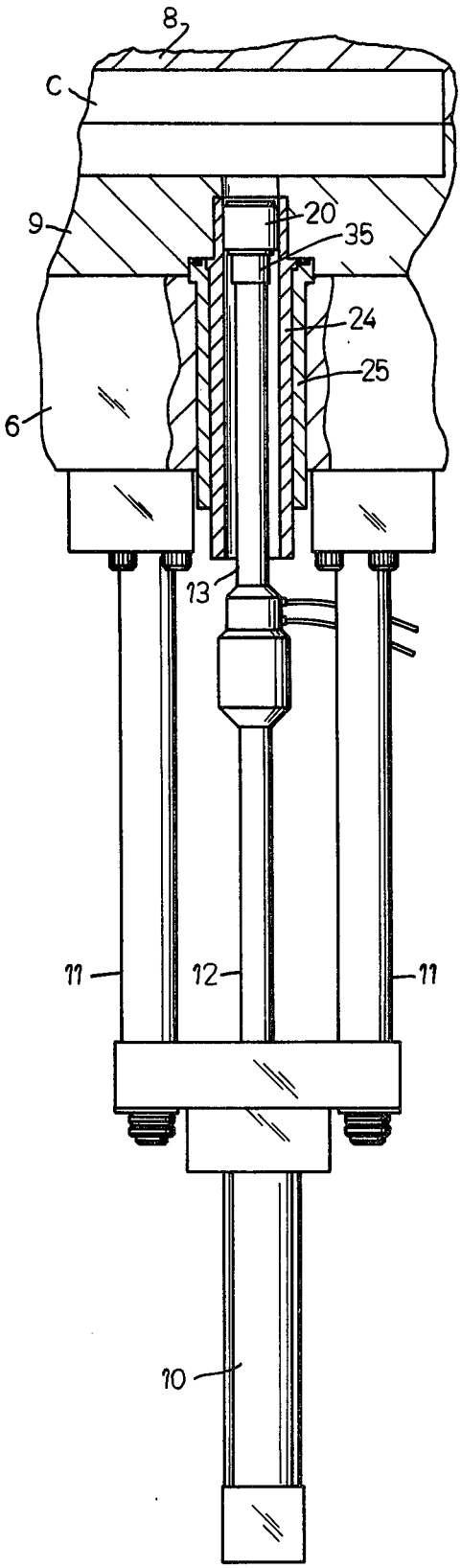
FIG. 3

INJECTION MOLDING MACHINE HAVING SWIVEL SHOT TIP ASSEMBLY

BACKGROUND OF THE INVENTION

1. Field of Use

The invention pertains to injection molding machines of the type in which molten material is drawn into a shot tube from a reservoir and a shot tip is powered through the shot tube to push the molten material into the die cavity of the machine. In conventional machines, these shot tips wear out rapidly if there is any side thrust or bending moment between them and the shot tube. These undesirable forces are developed by misalignment due to the close tolerances which must be held between the various parts of the machine and which result in flexing due to high compressive stresses, and the large number of severe impacts during the injection strokes. These misalignment problems exist between the shot tube and the shot tip as they are being telescoped together and result in rapid wearing of the shot tips due to the side thrust or bending action imposed upon them.

2. Description of the Prior Art

Examples of injection molding machines of the type to which the present invention generally relates are shown in the U.S. Pat. No. 2,741,006, issued Apr. 10, 1956 and entitled "Means for Delivering Charges of Molten Metal;" U.S. Pat. No. 1,994,824, issued Mar. 19, 1935 and entitled "Die Casting Machine;" U.S. Pat. No. 2,839,800, issued June 24, 1958 and entitled "Method of and Apparatus for Damping Shocks;" U.S. Pat. No. 3,171,172, issued Mar. 2, 1965 and entitled "Injection Pistons for Pressure Casting Machines;" and U.S. Pat. No. 2,656,576, issued Oct. 27, 1953 and entitled "Die Casting Machine."

SUMMARY OF THE PRESENT INVENTION

The present invention relates to a shot tip assembly for an injection molding machine of the type which has a shot tube for conducting molten material to a die cavity of the machine, the shot tip assembly having a shot tip reciprocal within the tube and forming a close sliding fit therewith for forcing said material through the tube and into the die cavity. The arrangement is such that the shot tip adapter has one end captively but relatively movably mounted in the shot tip while the other end of the adapter is fixed to a reciprocal shot rod. A movable or swivel connection is provided between the adapter and the tip to thereby permit the tip to move relative to or swivel on the adapter. This construction permits the tip to adjust within the tube so as to accommodate any misalignment therebetween and consequently, minimize or eliminate wear on the shot tip. A more specific aspect of the invention relates to an assembly of the above type in which the shot tip includes a collar threaded therein and which acts to hold the adapter captive within the tip and also provides a part of the swivel connection between the shot tip and the adapter. The invention also contemplates water inlet and outlet passages extending through the shot rod and in communication with the interior of the shot tip to cool the latter; sealing means are provided between the interior of the shot tip and the adapter to prevent loss of cooling water; the swivel connection between the adapter and the shot tip permits movement between the adapter and tip and about the sealing means so as to prevent damage to the sealing means or otherwise reduce its sealing ability, even though relative movement between the tip and adapter can occur. Still another aspect of the invention relates to the assembly of the above type in which the adapter is threadably engaged on the end of the shot rod so as to be removable therefrom for replacement or repair. A more specific aspect of the invention relates to an assembly of the above type in which the swivel connection is formed between the adapter and the shot tip collar. The adapter also has an enlarged inner end for abutting against the shot tip collar so as to hold one end of the adapter captive within the shot tip.

The invention provides an injection molding machine for a shot tip assembly of the above type, which machine has power means for reciprocably driving the shot rod to consequently drive the shot tip in the shot tube.

These and other objects and advantages of the invention will appear hereinafter as this disclosure progresses, reference being had to the accompanying drawings.

BRIEF DESCRIPTION OF THE DRAWINGS

FIG. 2 is an enlarged, fragmentary view of the lower portion of the machine shown in FIG. 1, certain parts being shown in section or broken away for the sake of clarity, and the view furthermore showing the shot tip in the retracted, i.e., shot tube loading position;

FIG. 2*a* is an enlarged, fragmentary view of a portion of the device shown in FIG. 2, and showing the water inlet and outlet passages for the shot rod;

FIG. 3 is a view similar to FIG. 2 but showing the shot tip in the innermost position after it has delivered a charge of molten material to the die cavity.

DESCRIPTION OF A PREFERRED EMBODIMENT

Figure 1:
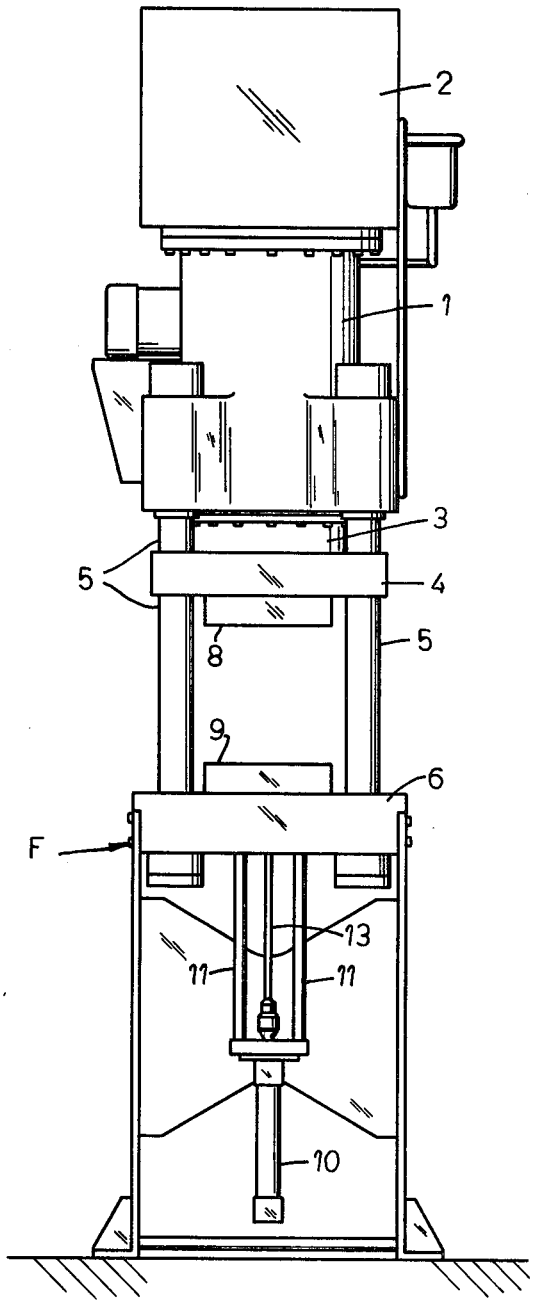
FIG. 1 is a front, vertical elevational view of an injection molding machine embodying the present invention.

The general organization of the injection molding machine of the present invention is shown in FIG. 1 and is of the type wherein the molding machine is arranged vertically, it being understood that other dispositions of the machines are possible as is conventional practice. The machine includes a generally elongated and vertical frame F on which are mounted a clamping cylinder 1 and a fluid reservoir 2 for the clamping cylinder, a clamping cylinder ram 3 which is reciprocal in the clamping cylinder and extends downwardly to and is connected with a movable platen 4. The machine also includes tie bars 5 and a stationary, lower platen 6. Complementary and cooperative dies 8 and 9 are secured to the movable and stationary platens, respectively, the dies forming a die cavity C (FIG. 2).

The lower end of the machine supports a vertically disposed shot cylinder 10 which is mounted to the stationary platen in a rigid manner by shot cylinder support bars 11.

The shot cylinder 10 has a reciprocal rod 12 mounted therein for being power driven or extended in a known manner by hydraulic pressure fluid. The cylinder rod 12 extends upwardly and has a portion 13 rigidly secured thereto. The shot rod 13, as shown clearly in FIGS. 2 and 4, has a central water inlet passage 16 and a water return passage 17 concentric therewith. These passages 16 and 17 are in fluid communication with the interior 18 of a cup-shaped shot tip 20. These passages provide cooling water to the interior of the shot tip 20.

The shot tip reciprocates in a shot tube 24 which is rigidly fixed in a shot tube water jacket 25 which in turn is rigidly fixed in the platen 6. The shot tube 24 has a molten metal loading port 27 (FIG. 2) through which molten metal is introduced into the shot tube from a molten metal reservoir (not shown). The shot tube communicates at its upper end as shown in FIGS. 2 and 3 with the die cavity C of the machine and is capable of conducting molten metal into the cavity under pressure.

Figure 6:
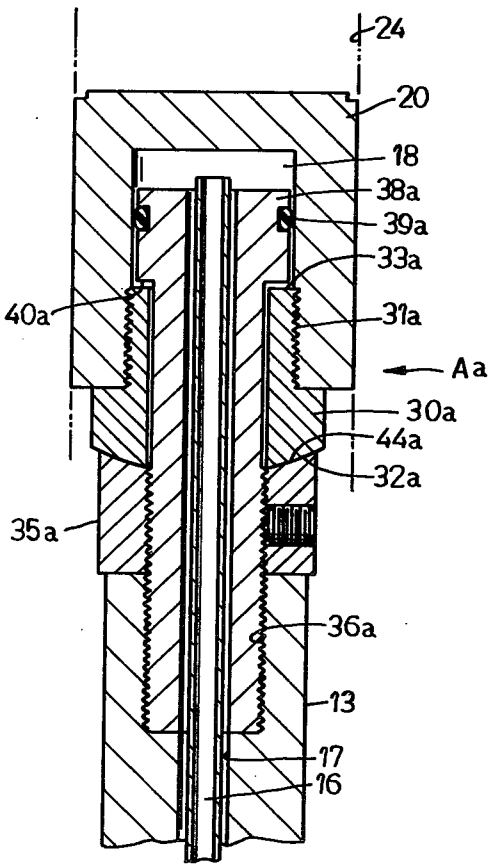
FIG. 6 is a view similar to FIG. 4 but showing a modification of the shot tip assembly.
Figure 5:
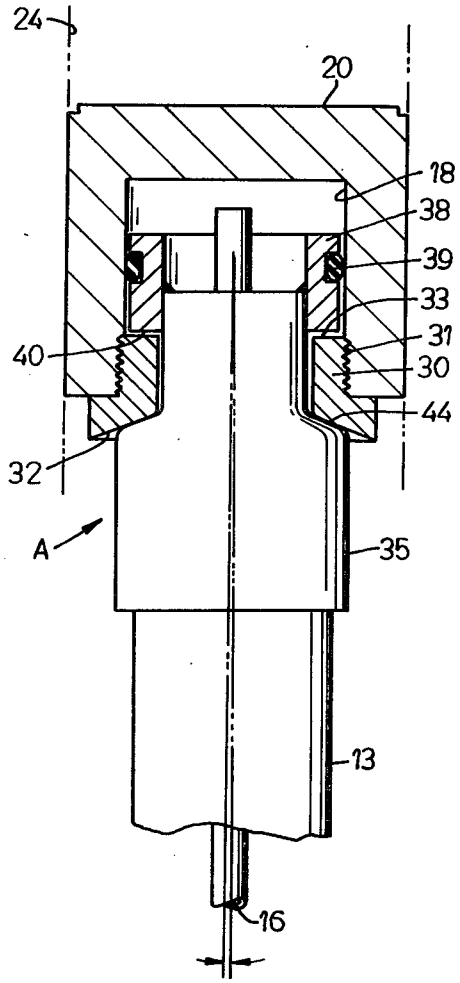
FIG. 5 is a view similar to FIG. 4 but showing certain of the parts in full elevational view with the rod tilted relative to the tip.
Figure 4:
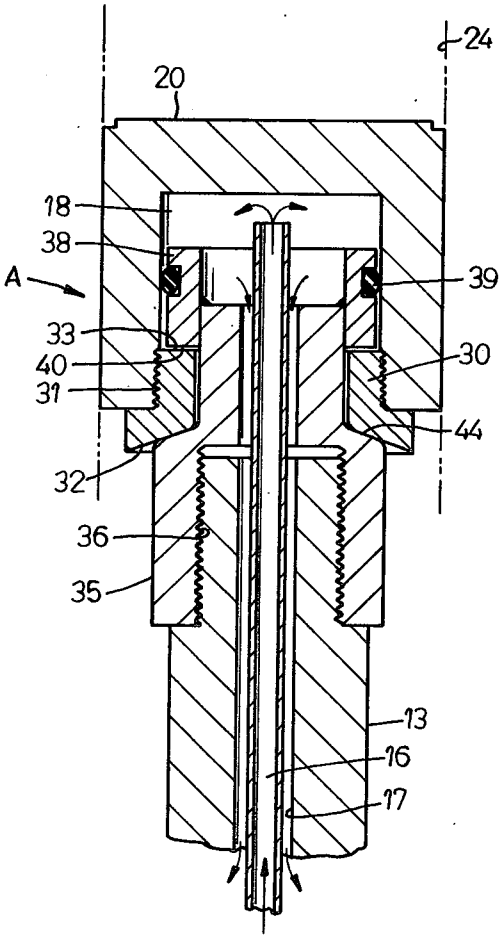
FIG. 4 is a further enlarged, fragmentary view of the shot tip assembly shown in FIGS. 2 and 3, the parts being shown in section for the sake of clarity.

The shot tube assembly A is shown in FIGS. 4–6 and more specific reference will now be made to FIGS. 4 and 5 which show one modification of the shot tube assembly. The shot tube assembly includes the shot tip 20 which in turn has a collar 30 threadably engaged thereon at 31. The collar has a swivel surface 32 on its outer end. The collar also has an inner abutting surface 33.

The shot tip assembly also includes a swivel shot tip adapter 35 which is threadably engaged at 36 on one end of the shot rod 13. The swivel shot tip adapter has a diametrically enlarged inner end 38 around which is mounted a sealing O-ring 39. The O-ring forms a seal between the interior of the shot tip and the enlarged inner end 38 of the adapter and this seal prevents loss of the cooling fluid within the shot tip and its also acts as the pivot point of the shot tip on the adapter, as will more fully appear. In this manner, although there is relative movement between the shot tip and the adapter, no damage occurs to the seal ring 39 nor does the latter lose any of its sealing ability.

The enlarged inner end 38 of the adapter has an abutting surface 40 which abuts against the surface 33 of the collar 30 and in this manner the adapter is captively but movably held within the shot tip.

The adapter 35 also has a swivel connection surface 44 which is complementary to and is in abutting engagement with the swivel connection surface 32 of the collar 30. Thus, the swivel connection formed between the shot tip collar and the adapter permits the tip to swivel (FIG. 5) relative to the shot rod and this in turn permits the shot tip to move or tilt slightly within the shot tube 24 as the tip is driven through the shot tube to deliver its charge of molten metal. By permitting this movement between the shot tip and the shot tube, any misalignment or eccentricity between the parts can be accommodated and wear of the shot tip is greatly reduced.

As a result, any misalignment problems that exist between the shot tube and the shot tip are accommodated as are any side thrust forces or bending action between them. Consequently, the arrangement permits close tolerances in the other parts of the machine, such as the piston rod and shaft bearings of the hydraulic cylinder 10, and the flexing which occurs due to high compressive stresses and the large number of severe impacts during the injection strokes. The modification shown in FIG. 6 operates like the FIG. 4 device and similar parts have been correspondingly numbered, some with the suffix "a" and it is not believed any further description of FIG. 6 is necessary.

I claim:

1. An injection molding machine of the type having a shot tube for conducting molten material to a die cavity, a shot tip assembly comprising a shot tip reciprocable within said tube and forming a close sliding fit therewith for forcing said material through said tube and into said cavity, a shot tip adapter having one end captively but movably mounted in said shot tip, a reciprocable shot rod rigidly connected to said adapter, and a swivel connection between said adapter and said tip to permit said tip to swivel on said adapter.

2. The machine set forth in claim 1 further characterized in that said shot tip has a collar threaded therein and for holding said adapter captive in said shot tip, said swivel connection being formed between said adapter and said collar.

3. The machine set forth in claim 2 further characterized in that said adapter is threadably engaged on said shot rod.

4. The machine set forth in claim 1 including water inlet and outlet passages extending through said shot rod and into the interior of said shot tip for cooling thereof.

5. The machine set forth in claim 2 including water inlet and outlet passages extending through said shot rod and into the interior of said shot tip for cooling thereof.

6. The machine as set forth in claim 4 including sealing means between said adapter and the interior of said shot tip.

7. The machine set forth in claim 2 further characterized in that said adapter has an enlarged end located in said shot tip, said enlarged end abutting against said collar to hold said adapter captive within said shot tip.

8. The machine set forth in claim 7 including water inlet and outlet passages extending through said shot rod and into the interior of said shot tip for cooling thereof.

9. The machine as set forth in claim 8 including sealing means between said adapter and the interior of said shot tip.

10. An injection molding machine of the type having a shot tube for conducting molten material to a die cavity, a shot tip assembly comprising a shot tip reciprocable within said tube and forming a close sliding fit therewith for forcing said material through said tube and into said cavity, a shot tip adapter having one end captively but movably mounted in said shot tip, said shot tip having a collar threaded therein and for holding said adapter captive in said shot tip, a reciprocable shot rod threadably connected to said adapter, a swivel connection between said adapter and said collar to permit said tip to swivel on said adapter, water inlet and outlet passages extending through said shot rod and into the interior of said shot tip for cooling thereof, and sealing means between said adapter and the interior of said shot tip.

11. The machine set forth in claim 10 further characterized in that said adapter has an enlarged end located in said shot tip, said enlarged end abutting against said collar to hold said adapter captive within said shot tip.

12. An injection molding machine comprising, a die cavity, a shot tube for conducting molten material into said cavity, a shot tip reciprocable within said tube and forming a close sliding fit therewith for forcing said material through said tube and into said cavity, a shot tip adapter having one end captively but movably mounted in said shot tip, said adapter also having an opposite end, a reciprocable shot rod rigidly connected to said adapter opposite end, a swivel connection between said adapter and said tip to permit said tip to swivel on said adapter; and power means for driving said shot rod to thereby drive said tip in said shot tube.

13. The machine described in claim 12 further characterized in that said power means comprises a hydraulic cylinder having a piston rod extensible therefrom, said shot rod being attached to said piston rod for reciprocation thereby.

14. The machine of claim 12 further characterized in that said shot tip has a collar threaded therein and for holding said adapter captive in said shot tip, said swivel connection being formed between said adapter and said collar.

15. The machine as described in claim 14 further characterized in that said adapter is threadably engaged on said shot rod.

16. The machine set forth in claim 12 including water inlet and outlet passages extending through said shot rod and into the interior of said shot tip for cooling thereof.

17. The machine set forth in claim 14 including water inlet and outlet passages extending through said shot rod and into the interior of said shot tip for cooling thereof.

18. The machine as set forth in claim 16 including sealing means between said adapter and the interior of said shot tip.

19. The machine set forth in claim 14 further characterized in that said adapter has an enlarged end located in said shot tip, said enlarged end abutting against said collar to hold said adapter captive within said shot tip.

20. The machine set forth in claim 19 including water inlet and outlet passages extending through said shot rod and into the interior of said shot tip for cooling thereof.

21. The machine as set forth in claim 20 including sealing means between said adapter and the interior of said shot tip.

22. An injection molding machine comprising, a die cavity, a shot tube for conducting molten material into said cavity, a shot tip having a collar threaded therein; said tip being reciprocable within said tube and forming a close sliding fit therewith for forcing said material through said tube and into said cavity, a shot tip adapter having one end captively held in said tip by said collar but movably mounted in said shot tip, said adapter also having an opposite end, a reciprocable shot rod threadably connected to said adapter opposite end, a swivel connection between said adapter and said collar to permit said tip to swivel on said adapter; a hydraulic cylinder having a piston rod extensible therefrom, said shot rod being attached to said piston rod for reciprocation thereby for driving said shot rod to thereby drive said tip in said shot tube; water inlet and outlet passages extending through said shot rod and into the interior of said shot tip for cooling thereof, and sealing means between said adapter and the interior of said shot tip.

23. The machine set forth in claim 22 further characterized in that said adapter has an enlarged end located in said shot tip, said enlarged end abutting against said collar to hold said adapter captive within said shot tip.

* * * * *